United States Patent [19]

Wagner

[11] 4,103,779

[45] Aug. 1, 1978

[54] BRUSH TENDER

[75] Inventor: Jerome Wagner, New York, N.Y.

[73] Assignee: Harry Fraider, New York, N.Y.

[21] Appl. No.: 680,378

[22] Filed: Apr. 26, 1976

[51] Int. Cl.[2] ..... A47B 81/02

[52] U.S. Cl. ..... 211/65; 248/113

[58] Field of Search ..... 211/65, 66, 59, 60 R, 211/120; 248/110–113; 15/246, 248 R; 135/48; 206/1.7, 214, 361, 362; 312/206; 401/131, 15

[56] References Cited

U.S. PATENT DOCUMENTS

| | | | |
|---|---|---|---|
| 2,278,650 | 4/1942 | Drinkwater | 211/120 X |
| 2,310,533 | 2/1943 | Lindell | 211/65 |
| 2,498,511 | 2/1950 | Smith | 248/113 |

FOREIGN PATENT DOCUMENTS

| | | | |
|---|---|---|---|
| 356,393 | 9/1922 | Fed. Rep. of Germany | 211/65 |

*Primary Examiner*—James T. McCall
*Assistant Examiner*—Terrell P. Lewis

[57] ABSTRACT

A device that will hold brushes upright for purposes that include drying, and for holding brushes with different pigments or mediums while working with other brushes. From the side of a receptacle for catching water dripping from drying brushes, there rises a stem holder on which are non-stationary stems upon which there are non-stationary spring-type clamping devices for holding brushes. More than one clamping device may be placed on each stem so as to increase brush holding capacity. When using thick-handled brushes, the stems may be placed further apart to provide extra space for each brush, and any surplus clamping devices may be stored on an elongated stem supported by the brush tender.

2 Claims, 2 Drawing Figures

BRUSH TENDER

BACKGROUND OF THE INVENTION

This invention pertains to devices that are used for holding brushes upright for purposes that include drying of said brushes.

Prior brush holders include three basic types; the coil spring type, the clamping type, and a combination of the two.

The coil spring type brush holder essentially has a coil spring in which each brush is held upright by being pressed between individual coils of a coil spring, each end of which is connected to the top of an upright piece, the bottom of each of which is connected to one side of a receptacle for catching water dripping from drying brushes. The top ends of the upright pieces are connected by a crosspiece that goes through the coil spring.

The essential improvement in the present invention over the coil spring type is that brushes having a broader range of handle thicknesses can be held (in the clamping devices) whereas brushes with relatively thick handles would have a tendency to weaken the tension of the coils of the coil spring type brush holder, thereby diminishing its capability of holding thinner handled brushes.

The prior clamping type brush holder has stationary clamping devices, and depending on the distance between each clamping device, the capacity for holding thicker handled brushes is gained at the expense of holding less thinner handled brushes due to the fact that the clamping devices, in order to be kept out of each other's way, would have to be placed further apart from each other, the wider they are opened.

The combination type brush holder has the disadvantage of the coil spring type, and in order to overcome the disadvantage of the prior clamping type, more than one stem holder would have to be placed on the receptacle to obtain the "flexibility" of the present brush tender which needs only one stem holder because the stems can be placed on different positions along the stem holder, in contrast to the necessity of a plurality of stem holders encircling stems, which is what would obtain were the combination type brush holder thus improved.

SUMMARY OF THE INVENTION

One object of this invention is to provide a brush holder in which brushes of varying handle thicknesses can be held upright by spring-type clamping devices without diminishing the usefulness of the brush holder such as would occur when using coil springs to hold brushes of varying handle thicknesses.

Another object of this invention is to enable a maximum of thin and/or thick handled brushes to be held by placing the stems where and when necessary, and by placing the spring-type clamping devices on the stems where and when necessary.

DESCRIPTION OF THE PREFERRED EMBODIMENT

Figure 2:
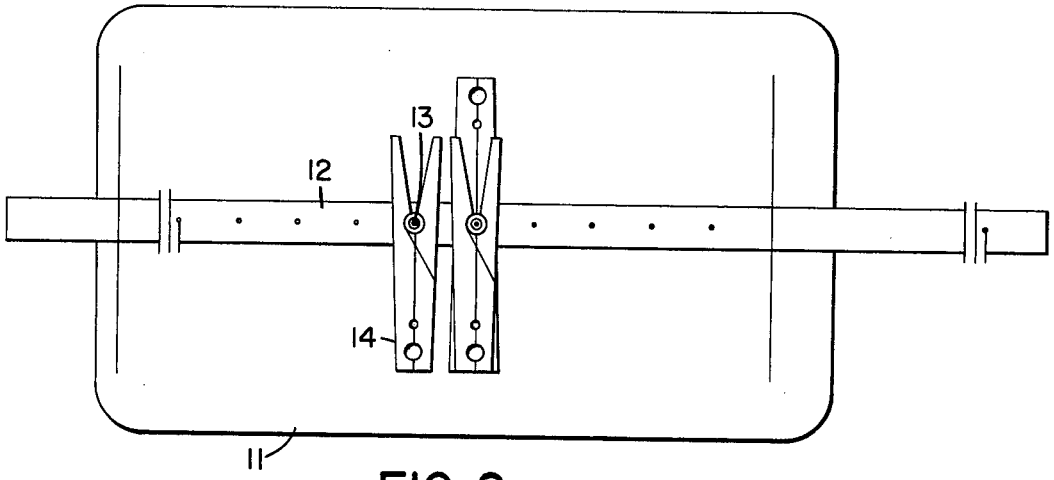
FIG. 2 is a top view of the brush tender.
Figure 1:
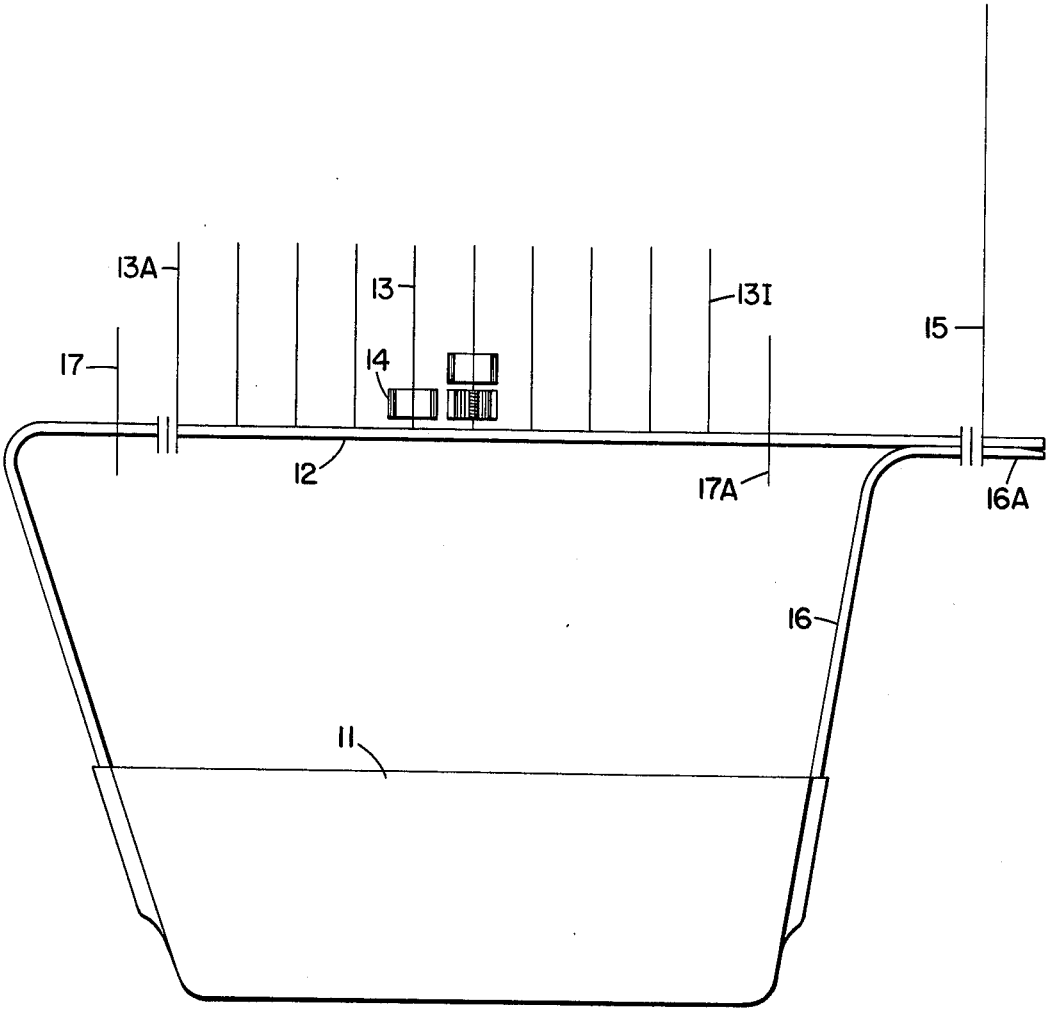
FIG. 1 is a side view of the brush tender.

Referring to FIGS. 1 and 2:

The essential structure of the present brush holder comprises a spring-type clamping device 14 functionally connected to a stem 13 which is functionally connected to a stem holder 12 which is functionally connected to a receptacle 11.

In the present specification, "functionally connected to" refers to any method whereby two or more components may be put together, whether it is a loose or tight connection, whether it is the reliance on gravity, riveting, bolting, welding, brazing, soldering, bonding, etc., or when one component is an extension of the other, becoming in effect a single component, or any other method that falls within the spirit and scope of the present invention which is essentially a device for holding brushes, of varying handle thicknesses, upright.

The brush tender in FIG. 1 shows a stem 15 functionally connected to stem holder 12 and to a descending member 16 which is functionally connected from receptacle 11 to stem holder 12.

A slight downward angle may be applied at point 16A so as to hold stem 15 more securely, as when it is wrapped around descending member 16 and stem holder 12. Other stems may be wrapped around stem holder 12 as depicted by stem 13A.

Steadying members 17 and 17A may be functionally connected to stem holder 12 outside the ends of the row of stems 13A to 13I, in order to prevent clamping devices from rotating on stems 13A and 13I to the point where brushes might touch the inside of receptacle 11.

One mode of using the brush tender is as follows: Spring-type clamping devices such as clothes pins, etc. are placed in alternate positions on bottom row in order to conserve space when clamping devices are open for holding brushes. Half of the clamping devices may be stored on stem 15. When additional brushes need be dried, stored clamping devices would be placed alternately on top of first row of clamping devices. The stems may be placed further apart when necessary to make room for thicker handled brushes.

Amounts and sizes of components would depend upon the way that the brush tender is used.

Usefulness of the brush tender is not limited to the above example, and, of course, it is possible to modify the brush tender, without departing from the spirit and scope of the invention as set forth in the following claim which is intended to include all such modifications.

I claim:

1. A brush tender including a receptacle, a stem holder, a plurality of stems, and a plurality of spring-type clamping devices, wherein the improvement comprises the stem holder disposed horizontally above, and functionally connected to, the receptacle, the stems disposed in spaced relation along the upper surface of, and functionally connected perpendicular to, the stem holder, at least one clamping device removably mounted on at least one stem, whereby, at least one brush may be releasably held above the receptacle by the at least one clamping device.

2. The brush tender of claim 1 wherein said stems are long enough to receive two of said clamping devices, whereby two brushes may be held on opposite sides of the stem holder by said two clamping devices.

* * * * *